US010143896B2

(12) United States Patent
Schuster

(10) Patent No.: US 10,143,896 B2
(45) Date of Patent: Dec. 4, 2018

(54) GOLF BALL HOLDER AND DISPENSING DEVICE

(71) Applicant: Paul Scott Schuster, Racine, WI (US)

(72) Inventor: Paul Scott Schuster, Racine, WI (US)

(73) Assignee: SnakeBelly, LLC, Racine, WI (US)

( * ) Notice: Subject to any disclaimer, the term of this patent is extended or adjusted under 35 U.S.C. 154(b) by 15 days.

(21) Appl. No.: 14/642,711

(22) Filed: Mar. 9, 2015

(65) Prior Publication Data

US 2016/0263445 A1 Sep. 15, 2016

(51) Int. Cl.

*A63B 47/00* (2006.01)
*A63B 57/20* (2015.01)
*A63B 55/20* (2015.01)

(52) U.S. Cl.

CPC ..... *A63B 47/002* (2013.01); *A63B 55/20* (2015.10); *A63B 57/20* (2015.10); *A63B 2210/50* (2013.01)

(58) Field of Classification Search

CPC ..... A63B 47/002; A63B 55/20; A63B 57/20; A63B 2210/50

USPC ..... 206/315.9; 211/14–15, 59.2; 221/155, 221/185, 199, 227, 247, 279, 303, 307; D3/215, 221, 224, 254, 257; 224/918–919; 294/19.2

See application file for complete search history.

(56) References Cited

U.S. PATENT DOCUMENTS 1,718,952 A * 7/1929 Fischer ..... A63B 55/20 206/315.9
2,757,698 A * 8/1956 Goodman ..... A63B 55/20 206/315.9
3,465,993 A * 9/1969 Muehlhausen ..... A63B 55/50 135/81
3,777,933 A * 12/1973 Joliot ..... A63B 47/001 206/315.9
3,980,215 A * 9/1976 Schwarzbauer ..... A45C 11/24 206/315.9
4,244,497 A * 1/1981 Lee ..... B62J 7/06 224/420
4,550,930 A * 11/1985 Proffit ..... B62B 5/085 224/274
D360,974 S * 8/1995 Stalling ..... D3/221
D370,340 S * 6/1996 Berger ..... D3/221
D374,345 S * 10/1996 Ostrosky ..... D3/221
5,997,062 A * 12/1999 Schwartz ..... A63B 47/02 294/19.2
6,053,821 A * 4/2000 Palmer ..... A63B 57/0037 473/386
6,257,990 B1 * 7/2001 Kariatsumari ..... A63B 47/02 294/19.2

(Continued)

*Primary Examiner* — Chun Cheung
*Assistant Examiner* — Brijesh V. Patel
(74) *Attorney, Agent, or Firm* — Jansson Munger McKinley & Kirby Ltd.

(57) ABSTRACT

A golf ball storing/releasing device is formed of a single length of rod having a modulus of elasticity and bent to form a golf-ball-supporting track. The track having back and front sections. Each section including first and second spaced-apart portions, the first portions of the back and front sections forming a first side portion and the second portions of the back and front sections forming a second side portion. The spaced-apart portions all being dimensioned less than the diameter of a golf ball. The first and second side portions converging toward one another from the turnaround sections to a ball-entry juncture section.

3 Claims, 5 Drawing Sheets

(56) References Cited

U.S. PATENT DOCUMENTS

| | | | | |
|---|---|---|---|---|
| 6,439,424 | B1 * | 8/2002 | Threadgill, Jr. | A63B 47/002 221/185 |
| 6,471,055 | B1 * | 10/2002 | Kwiecienski | A63B 55/50 206/315.2 |
| 7,398,888 | B1 * | 7/2008 | Nowak | A63B 71/0036 206/315.9 |
| 8,646,622 | B2 * | 2/2014 | Wollert | F16M 11/041 211/105.6 |
| 2004/0094565 | A1 * | 5/2004 | Bosanac | A63B 47/002 221/247 |
| 2006/0118443 | A1 * | 6/2006 | Chan | A63B 55/20 206/315.9 |
| 2009/0194552 | A1 * | 8/2009 | Jeremias | A63B 47/002 221/14 |
| 2010/0187252 | A1 * | 7/2010 | Smith | A63B 47/00 221/155 |
| 2013/0092572 | A1 * | 4/2013 | Proulx | A63B 47/002 206/315.2 |
| 2014/0237777 | A1 * | 8/2014 | Braggion | B60R 13/0206 24/297 |

* cited by examiner

Fig 7A
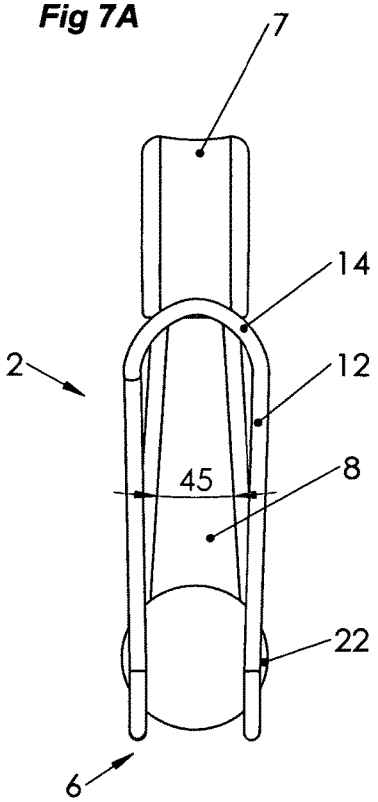
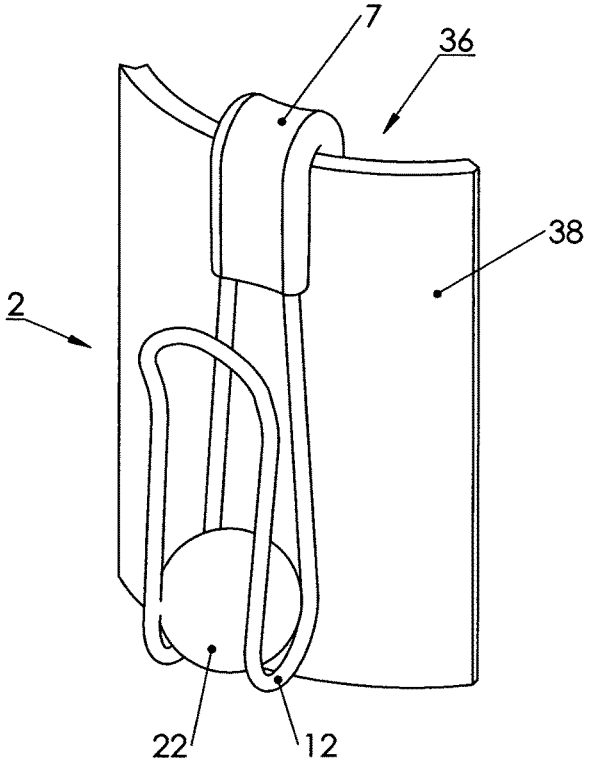
Fig 7B
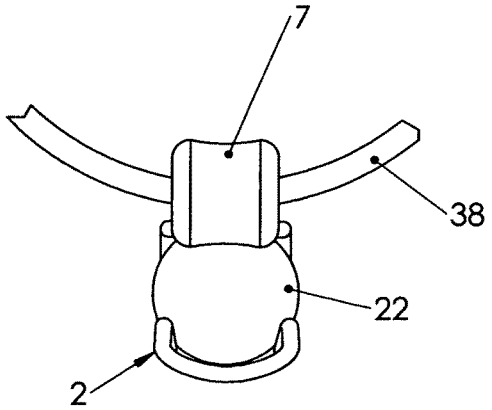
Fig 7C

GOLF BALL HOLDER AND DISPENSING DEVICE

This application claims the benefit of U.S. Provisional Application No. 61/951,504, filed Mar. 11, 2014

BACKGROUND OF THE INVENTION

The present invention pertains to the accessibility of the golf ball by a player in sport of golf, where the golf ball is the main component of the game. Since golf balls can be lost during a round of golf through course hazards, players require access to their supply of golf balls throughout the round. The golf bags used to carry the player's equipment around the course are designed with a club access area at the top of the bag and golf ball storage at the bottom. The storage area is traditionally in the form of a large zippered pocket.

To play golf at a high level of performance requires an equally high level of concentration. Professional Players have a caddy to provide assistance, but non-professional Players carry and access their own bag. Searching through a lower storage pocket to find a new ball to play is not only a distraction, but can break this concentration. There are ball pouches available commercially that can be clipped to the bag's accessory ring to provide additional ball storage, but the accessibility is only slightly improved and they generally require two hands to operate. The prior art describes clip-on ball carriers that hold single or multiple golf balls. Some are intended to be worn by the Player, but could cause a distraction during the players swing. Other inventions clip onto the bag directly, but their designs typically are not balanced properly causing ball removal forces to work open or disengage their mounting clips during use. Accordingly, there exists a need for a reliable golf ball holder to provide Players instant access to golf balls; located at an optimal location for efficient use.

SUMMARY OF THE INVENTION

The described invention overcomes the issues described above by creating a golf ball storage device that provides instant accessibility and maximizes efficiency by securing the device at the top of the bag. The preferred invention is formed from a single length of rod and can hold a sleeve of golf balls in its storage area. Players simply grasp the balls and pull them out as needed.

The invention's hook shaped mount works in opposition to the downward removal force of the ball, stabilizing the installation during use. Since the forces are balanced, the invention provides Players true single hand use which is handy when they have a golf club in the other. The open frame design also provides visual identification of the remaining golf balls in the holder from any viewing angle. The inventions unique mounting structure provides attachment options for not only bags, but motorized carts, push carts, and other golf related surfaces.

The invention further comprises a unique leg mounted design when combined with a carry/stand style golf bag. Stand bags have a built in leg mechanism that levers the legs open when the bag is placed on the ground, and retracts them when the bag is picked up. Combining this action with the described invention provides players with a ball storage device that presents itself when the bag is grounded to access clubs, and retracts along with the legs when the shot is complete. This embodiment gives Players the ultimate convenience in ball and club selection in the same area, and the added benefit of retracting to a storage position under the bag once the shot is complete.

BRIEF DESCRIPTION OF DRAWING FIGURES

Figure 6A:
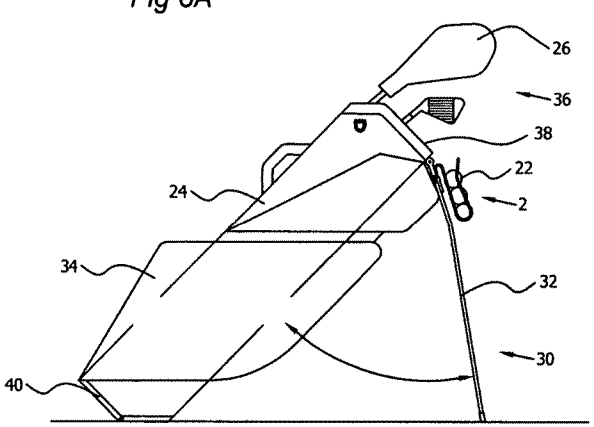
Figure 6B:
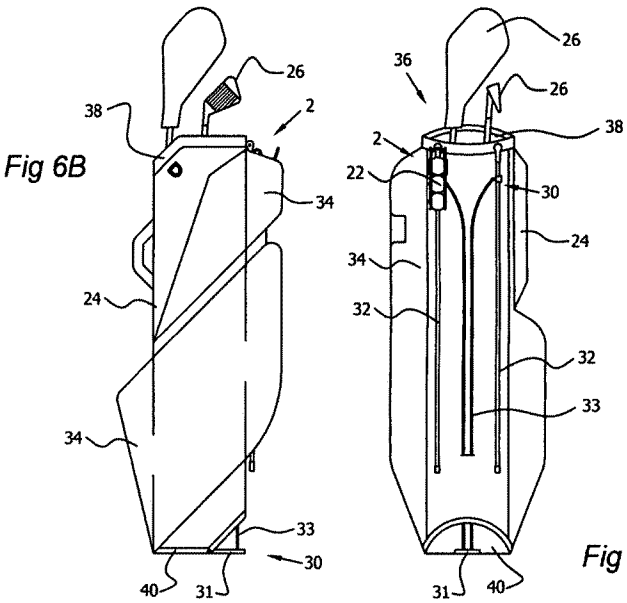
Figure 6C:
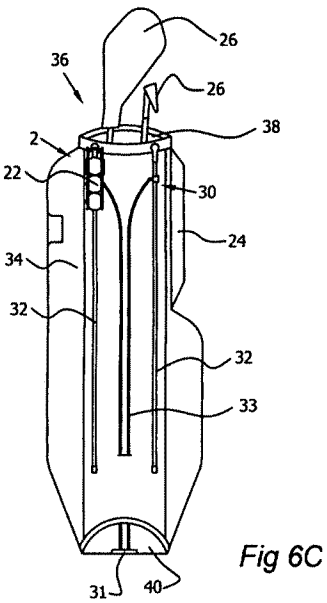

FIG. 6A shows a side view of the invention attached to the leg of a golf ball stand. FIG. 6B shows the same side view of the bag in FIG. 6A with the stand legs retracted. FIG. 6C shows a bottom view of the bag in FIG. 6B.

FIG. 7A shows a front view of the preferred embodiment of the invention with a single ball in the storage area. FIG. 7B shows an isometric view of the embodiment of FIG. 7A attached to a rim of a golf bag. FIG. 7C is a top view of FIG. 7B.

Figure 8A:
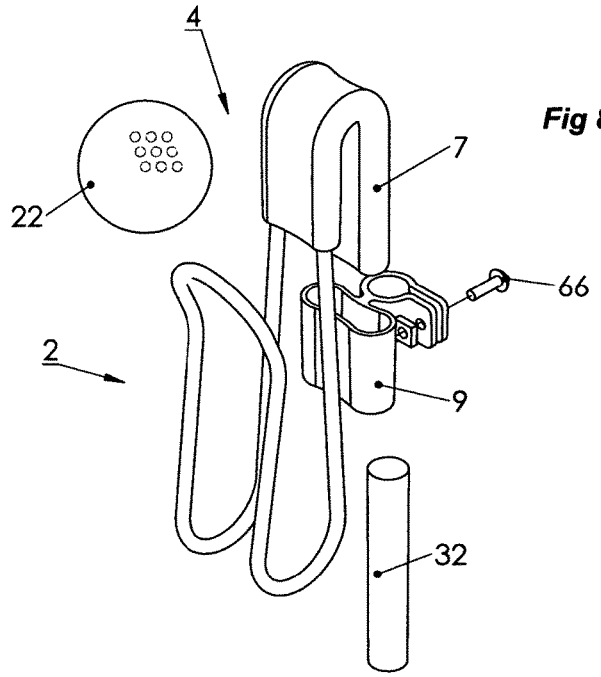
Figure 8B:
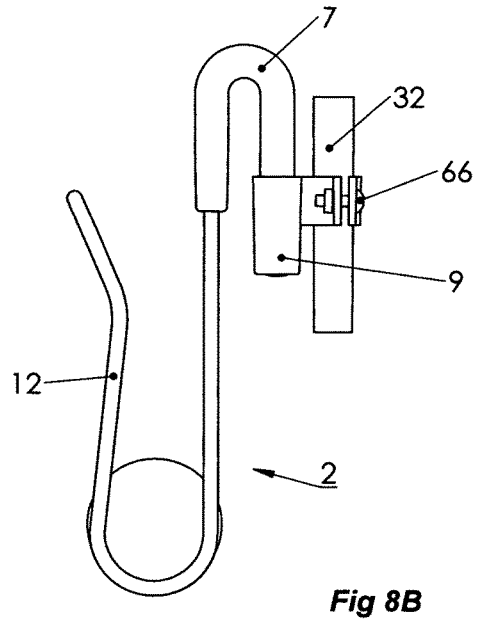
Figure 8C:
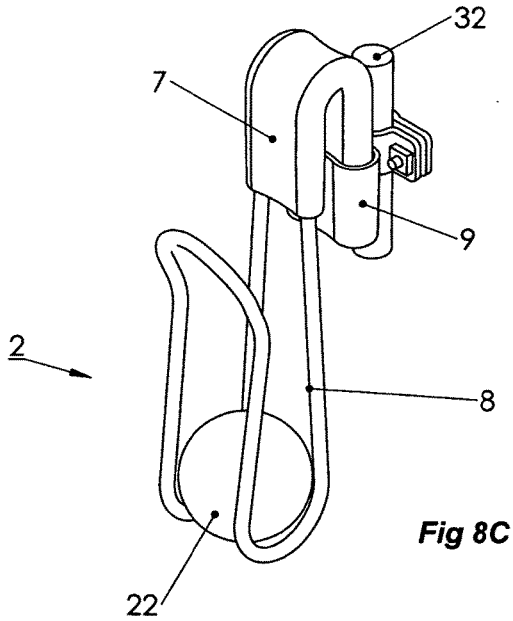

FIG. 8A shows an exploded view of the golf ball holder attached to a stand support leg by a base clamp assembly. FIG. 8B shows a side view of the golf ball attached to a support leg of a retractable stand by a mounting base. FIG. 8C shows an isometric view of FIG. 8B.

DETAIL DESCRIPTION OF THE INVENTION, FIGS. 1-6

Figures 1A, 1B, 1C, 2A, 2B, 2C, 2D, 2E, 2F, 2G, 2H:
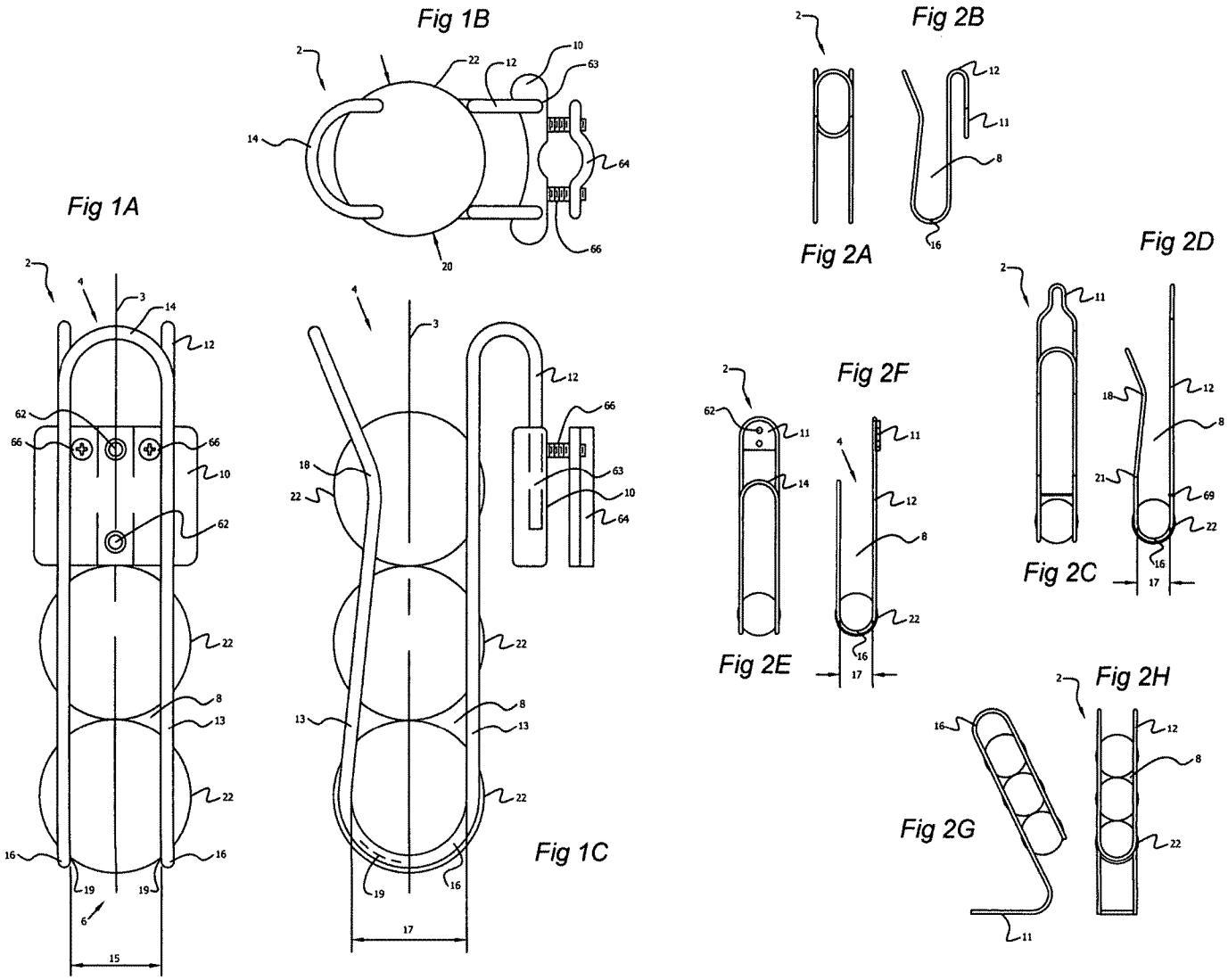
FIG. 1A shows the front view of the golf ball holder invention holding two golf balls in the storage area for clarity of the mounting base.
FIG. 1B shows a top view.
FIG. 1C shows a side view of the invention holding three golf balls.
FIG. 2A shows a front view and FIG. 2B a side view of an embodiment of the invention formed from a single rod.
FIG. 2C shows a front view and FIG. 2D a side view of an embodiment of the invention with an extended storage area.
FIG. 2E shows a front view and FIG. 2F a side view of an embodiment of the invention with mounting structure and the distance between track legs.
FIG. 2G shows a front view and FIG. 2H a side view of an embodiment of the invention with structure to balance on a flat surface.

FIG. 1A shows an embodiment of the invention with an external quad track frame. It is described retaining (3) golf balls, but the design would be applicable with a single or multiple balls in storage. The diameter of a golf ball is about 1.68 inches. Referring to FIGS. 1A & 1B, the embodiment features a rod frame body 12 that is formed froth a single ⅛ inch diameter metallic rod about 32 inches in length. Body 42 is first bent into a u-shape track 14 where distance 15 between the track legs is wide enough to let a portion of ball 22's surface to pass through the top surface of track 14, but not wider than ball diameter 20 of ball 22; such that the surface of ball 22 can slide or roll on the surface of track 14. Referring now to the embodiment in FIG. 2F, in a plane perpendicular to track 14, body 12 is further formed into a second u-shape quad retaining track 16 where distance 17 between the track legs is wide enough to let a portion of the ball's surface to pass through the top surface of track 16, but not wider than diameter 20 of ball 22; such that the surface of ball 22 can slide or roll on track 16.

Figure 5A:
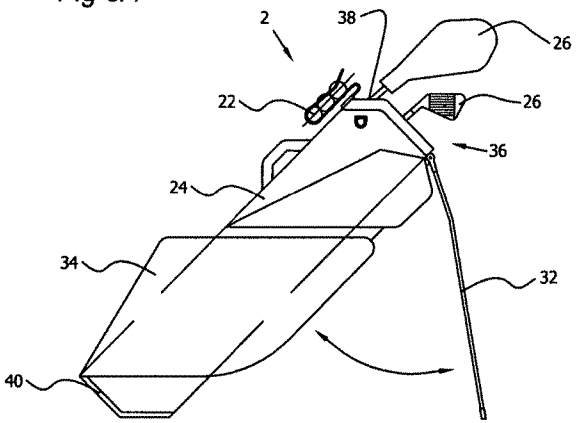
FIG. 5A shows a side view of the invention attached to the rim of a golf bag.
Figure 5B:
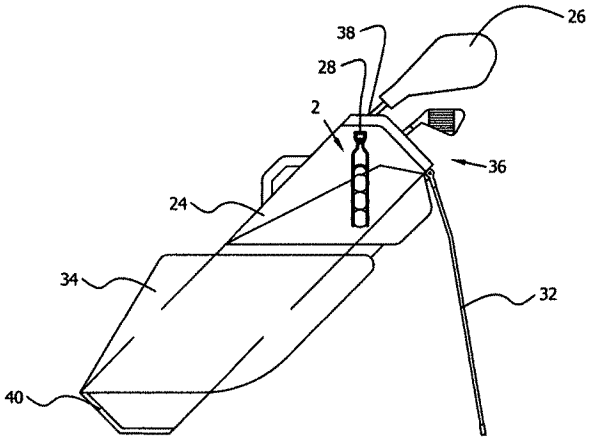
FIG. 5B shows a front view of the embodiment of FIG. 2C attached to an accessory ring of a golf bag.

The open ends of the body 12 can be formed into a mounting structure 11 as shown in FIG. 2C, and be mounted to a golf bag 24 as shown in FIG. 5B attached to bag accessory ring 28. The shape would also allow a fastener 66 through to mount. The clip shape described in FIG. 2B could be clipped for example at the rim of the golf bag top 38 like shown in FIG. 7B. FIGS. 2E & 2F show the open ends of body 12 closed around a welded in structure 11 that can facilitate attachment to a structure through use of fastener 66 through holes 62. FIG. 2G shows an embodiment with structure 11 formed to balance device 2 on a flat surface with past parallel bend 16. It is important to note that all embodiments of structure 11 are designed to allow the elasticity of body 12's material, known as Young's modulus, to expand to a point and return to its original shape after use.

Figure 3C:
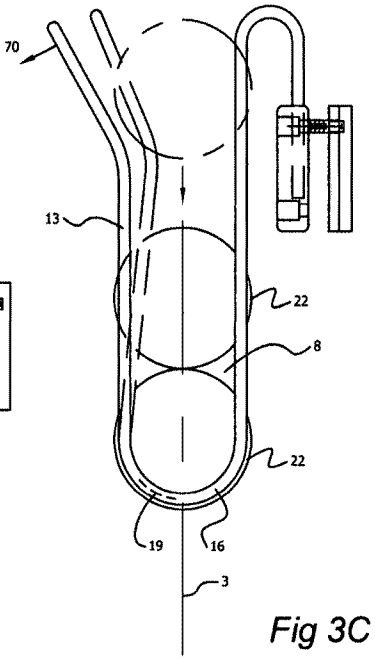
FIG. 3C shows the same view as FIG. 3B, showing the front track pulled forward and re-aligned allowing the golf ball to enter the storage area.
Figure 3A:
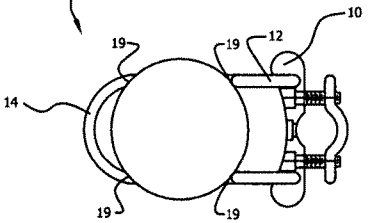
FIG. 3A shows a top view with a golf ball at rest in in the load area.
Figure 3B:
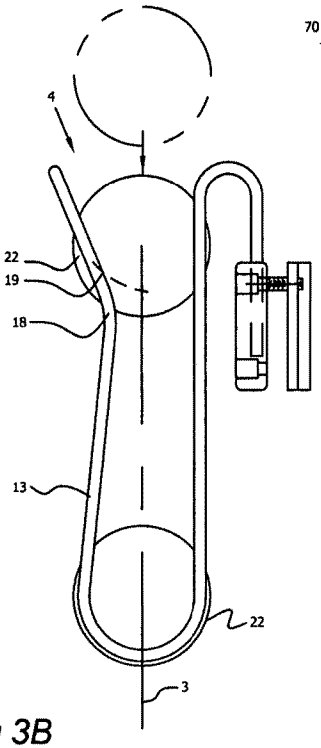
FIG. 3B shows a side view of a ball loaded along the device axis.

The embodiments of device 2 will function at this point, but a few additional features can be incorporated to improve usage for the Player. Referring now to FIG. 1C, the ball loading area 4 of device 2 is improved by forming a lead-in guide bend 18 into the front track legs 13 of bend 16. Bend 18 increases area 4, and positions ball 22 onto track 14 to enter device 2. To hold ball 22 in area 4 prior to storage, track bend 16 is further formed so that track legs 13 are past parallel, wherein ball 22 is in surface contact 19 with bend 18 (FIGS. 3A & 3B). Bend 18 also secures ball 22 within the storage area 8. Depending on how many balls are stored within device 2, an independent retaining bend 21 may occur at a location above track bend 16 as the length of the ball storage area 8 increases in length (as shown in FIG. 2D). After forming bend 16, the material selected must remain in the elastic region during use, and springback afterwards such that the described shape of device 2 is retained after use.

Referring now to FIG. 1C, the open ends of body 12 are terminated into the rod mating holes 63 of mounting base 10. Base 10 can be employed by riveting, gluing, welding, or molded within a structure for a permanent dedicated use. For a non-permanent attachment method, base 10 can be attached to a structure such as a golf cart with fasteners 66 through mounting holes 62 (FIG. 1A). Base 10 can also be clamped to a structure by attaching mounting clamp 64 with fastener 66 as shown in FIGS. 1B & 1C. Tightening fasteners 66 creates a clamping action by pulling base 10 and clamp 64 together. FIG. 5A shows the embodiment of FIG. 1C clamped to the golf bag top 38 of bag 24, positioning device 2 at the golf bag club access area 36. FIGS. 6A-6C shows the embodiment of FIG. 1B clamped to the bag support leg 32 of the bag stand assembly 30 which is employed on bag 24. FIGS. 5*a*-5*b* and 6*a*-6*c* illustrate the bottom of golf bag 40.

It is known that individual pieces can be assembled to achieve the same unique results as the single piece of rod used in the construction of device 2. The unique shape body 12 can also be formed or molded from other materials to emulate the structure described in FIGS. 1A-2H. It is known there are many mounting styles including a spring clamp for base 10. Body 12 can be surface treated, covered in paint, rubber, and or expandable sleeving to add both texture and traction to device 2.

Operation FIGS. 3-4

FIGS. 3A-4B show the loading and unloading of storage device. Referring to FIG. 3B, ball 22 is placed in loading area 4. In this position, ball 22 can either enter into the device 2, or can be simply removed without storage as shown at rest in FIGS. 3A & 3B. To store ball 22 sitting at rest, body 12 is expanded by pulling front track 13 forward as depicted in FIG. 3C. This action re-aligns track bend 16 with distance 17 and removes contact 19 so ball 22 can enter storage area 4. Ball 22 can also be stored into area 8 from rest by pushing it downward along device axis 3 running through area 4 of device 2. During this action, track 13 is expanded open within its elastic region by surface contact 19 of ball 22 pushing against the surface of front track 13 as it enters area 8.

Figure 4B:
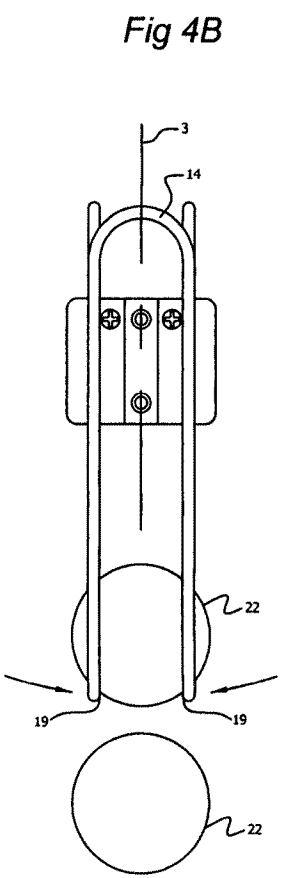
FIG. 4B shows the spring back of the tracks after the golf ball is fully removed.
Figure 4A:
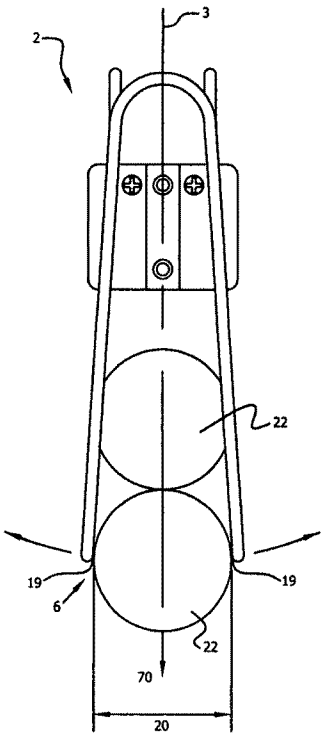
FIG. 4A shows a front view of the device in FIG. 3C, showing the tracks expanded as a golf ball is removed along the device axis.

FIGS. 4A & 4B show how to remove ball 22 from storage area 8 at ball unloading area 6. Referring to FIG. 4A, when Ball 22 is pulled downward with a force 70 along device axis 3 through area 6 of device 2, track 14 is expanded open within its elastic region by surface contact 19 of ball 22 pushing against the surface of bends 16 until reaching the ball diameter 20. When diameter 20 clears bends 16, the tracks spring back closed like a cam-follower against ball 22's surface as it is fully removed. The remaining ball(s) 22 are now retained in area 8 (FIG. 4B).

Detail Description of the Invention, FIGS. 7-8

The preferred embodiment of device 2 is shown in FIGS. 7A-8C constructed with a slightly longer 3/16 inch diameter aluminum rod. Referring to FIG. 7A, device 2's track 14 is slightly past parallel as previously shown in FIG. 1A. In this embodiment body 12 is fitted with grip pad 7 that follows the contour of structure 11's hook shape through its internal cavity. The grips internal cavity width is less than distance 15 plus rod diameter, causing the legs of track 14 to have an inward-taper angle 45 as shown in FIG. 7A. Taper angle 45 does not change the function of device 2 as described herein. Pad 7 can be made from many elastic materials, but rubber is preferred to provide both grip and flexibility to accommodate body 12's expansion and springback during use. Pad 7 can be attached by glue, friction, or molded in place. Structure 11 could also employ a dipped type vinyl or rubber coating. The use of Pad 7 allows device 2 to be securely clipped onto bag 24 at many locations including the rim of top area 38 as shown in FIGS. 7B & 7C. It also protects the shafts of golf club equipment 26 from coming in contact with body 12 during play.

FIGS. 8A-8C show a method for attaching the embodiment of FIG. 7A to bag support leg 32. Referring to the exploded diagram in FIG. 8A, pad 7 of device 2 is shown to be inserted into mounting base 9. Base 9 has an inside pocket that is shaped to fit the contour of pad 7, and makes a secure fit with pad 7 once fully inserted as shown in FIGS. 8B & 8C. Base 9 can be made from many materials including metal or plastic, but plastic is preferred when using the injection molding process. Base 9 includes clamping structure that provides the clamping opportunities of clamp 64. In FIGS. 8B & 8C, base 9 is clamped to leg 32 with fastener 66. Base 9's clamp is designed so its internal radius reduces as fastener 66 is tightened, thereby securing it to leg 32.

Operation FIGS. 6 & 8

FIGS. 6A-6C & 8A-8C show embodiments of device 2 installed on leg 32 of assembly 30 employed on bag 24. It is known assembly 30 can be configured in many ways to deploy leg 32, but the most common is described herein. As seen in FIG. 6A, when bag 24 is placed on lever pad 31, its weight pivots pad 31 and deploys legs 32 of assembly 30 through linkage 33. As a result, Device 2 is presented to the player directly by golf club equipment 26 in the club access area 36. This gives players the ultimate convenience in golf ball selection, and improves the flow of the game. As the player lifts bag 24 off of pad 31 after the play, device 2 retracts under bag 24 and storage pockets 34 as assembly 30 returns to its retracted state (FIGS. 6B & 6C).

The attachment method of device 2 to leg 32 can made with adhesive, fasteners, clamps. Device 2 can also be molded within the bag stand assembly 30, its components, or bag 24 to have a custom fit. Once attached, device 2 becomes a rigid part of bag 24 for dedicated use by the player.

Scope of the Invention

Although the descriptions above contain many specifics, these should not be construed as limiting the scope of the invention but as merely providing illustrations of some of the presently preferred embodiments of this invention to improve the flow of the game while providing Players the ultimate convenience in ball and club selection in the same area. Thus the scope of the invention should be determined by the appended claims.

I claim:

1. In a two-stage golf ball storing and releasing device formed of a single length of rod bent to form a golf-ball-supporting track, the golf-ball-supporting track having back and front sections, a turnaround section therebetween, and a ball-entry juncture track section at the top of the front section, each section including first and second spaced-apart portions of the single length of rod, the first portions of the back and front sections forming a first side portion and the second portions of the back and front sections forming a second side portion, the improvement comprising:

the spaced-apart portions of the back section diverging from a top end of the back section to the turnaround section;

the spaced-apart portions of the front section diverging from the turnaround section to the ball-entry juncture track section, the ball-entry track juncture section converging toward the back section and forming a storing section and a holding section, and being configured to secure and hold a golf ball in the holding section at a top end of the device in a first stage and to store a golf ball at a bottom end of the device in a second stage;

the spaced-apart portions all being dimensioned less than the diameter of a golf ball;

the front and back sections converging toward each other from the turnaround section;

the rod having a modulus of elasticity such that the first and second side portions are resiliently spreadable to the diameter of a golf ball with respect to one another and the front and back sections are resiliently spreadable with respect to one another;

a hook formed by a top end of the back section and supporting track ends and having a turnaround section therebetween; and a pad having a width and being shaped to the contour of the hook, the pad having an internal cavity to space apart and retain within the first and second side portions as well as being constructed of a flexible material able to deform and reform during spreadable resiliency of the first and second side portions.

2. The golf ball storing and releasing device of claim 1 wherein the rod is made from aluminum having a diameter of about 3/16 of an inch.

3. The golf ball storing and releasing device of claim 1 wherein the pad is made of rubber.

* * * * *